US008133079B2

(12) United States Patent
He

(10) Patent No.: US 8,133,079 B2
(45) Date of Patent: Mar. 13, 2012

(54) CONNECTOR HAVING IMPROVED HOUSING TO POSITION CONTACTS THEREOF RELIABLY

(75) Inventor: Jia-Yong He, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/097,073

(22) Filed: Apr. 29, 2011

(65) Prior Publication Data

US 2011/0269345 A1 Nov. 3, 2011

(51) Int. Cl.
*H01R 24/00* (2011.01)

(52) U.S. Cl. ..... 439/660

(58) Field of Classification Search ..... 439/660, 439/217

See application file for complete search history.

(56) References Cited

U.S. PATENT DOCUMENTS

| | | | | |
|---|---|---|---|---|
| 7,909,653 | B1 * | 3/2011 | Wan et al. | 439/660 |
| 7,938,659 | B1 * | 5/2011 | Zhu et al. | 439/218 |
| 7,942,704 | B2 * | 5/2011 | Ko et al. | 439/660 |
| 2009/0258514 | A1 | 10/2009 | He et al. | |

* cited by examiner

*Primary Examiner* — Phuong Dinh

(74) *Attorney, Agent, or Firm* — Wei Te Chung; Andrew C. Cheng; Ming Chieh Chang

(57) ABSTRACT

An electrical connector comprises an insulative housing having a base portion, and a tongue portion extending forwardly from the base portion, the base portion defining a cavity recessed from an upper surface thereof and communicating with a mating port, a bottom wall below the cavity and having a plurality of receiving slots, and a plurality of retaining slots which each is communicated with each two adjacent receiving slots. A plurality of first contacts each has a contact portion, a retaining portion extending rearwardly from the contact portion, and a pair of projections protruding outwardly from two lateral sides of the retaining portion along a transverse direction perpendicular to the front-to-back direction. The retaining portions are received in the corresponding receiving slots downwardly. The projections are positioned in the corresponding retaining slots to prevent the first contacts from moving along the front-to-back direction.

17 Claims, 6 Drawing Sheets

CONNECTOR HAVING IMPROVED HOUSING TO POSITION CONTACTS THEREOF RELIABLY

BACKGROUND OF THE INVENTION

1. Field of the Invention

The present invention relates to an electrical connector, and more particularly to an electrical connector having an improved housing to position contacts thereof reliably. The application relates to the copending application titled "CONNECTOR HAVING IMPROVED CONTACTS ARRANGEMENT", with one same inventor, the same assignee and the same fling date.

2. Description of Related Art

At present, Universal Serial BUS (USB) is a widely used as an input/output interface adapted for many electronic devices, such as personal computer and related peripherals. US Patent application publish No. 2009/0258514A1 discloses an universal serial bus (USB) connector which includes an insulative housing, a plurality of contacts retained in the housing, and a metal shell enclosing the housing. The housing has a base portion, and a tongue portion protruding forwardly from the base portion. The base portion defines a plurality of depressions recessed inwardly from a lateral surface thereof, and a plurality of holding grooves recessed from a front surface thereof and communicating with corresponding depressions respectively. The tongue portion defines a plurality of passageways communicating with corresponding holding grooves respectively. The contacts are retained in the housing downwardly and each defines a retaining portion retained in the depression, a middle portion received in the holding groove, a locating portion received in the passageway, and a contact portion located on an end of the locating portion. The middle portion is connected between the retaining portion and the locating portion. The contacts are prevented from moving along a left-to-right direction by the depressions, the holding grooves and the passageways. However, it is difficulty for the housing to secure the contacts along a front-to-back direction reliably.

Hence, an improved electrical connector is desired to overcome the above problems.

BRIEF SUMMARY OF THE INVENTION

According to one aspect of the present invention, an electrical connector comprises: an insulative housing having a base portion, and a tongue portion extending forwardly from the base portion, the base portion having a cavity recessed from an upper surface thereof, a bottom wall located below the cavity and defining a plurality of receiving slots extending along a front-to-back direction, and a plurality of retaining slots which each is communicated with each two adjacent receiving slots; a plurality of first contacts extending along the front-to-back direction and each having a contact portion, a retaining portion extending rearwardly from the contact portion, a pair of projections protruding outwardly from two lateral sides of the retaining portion along a transverse direction perpendicular to the front-to-back direction, and a tail portion extending beyond the insulative housing, the retaining portions received in the corresponding receiving slots after through the cavity, and the projections positioned in the corresponding retaining slots to prevent the first contacts from moving along the front-to-back direction; a plurality of second contacts received in the insulative housing, and each having a contact portion located at front of the contact portions of the first contacts, and a tail portion extending beyond the insulative housing; and a metal shell shielding the insulative housing.

According to another aspect of the present invention, an electrical connector with a front mating port for receiving a mating connector, comprises: an insulative housing includes a base portion, and a tongue portion extending forwardly from the base portion, the base portion defining a rear step portion, a pair of side walls extending forwardly from two lateral sides of the step portion to form a cavity thereamong, the tongue portion defining an upper side face, and a lower side face opposite to the upper side face; a set of first contacts retained in the insulative housing, and having first contact portions located on the upper side surface and exposed into the mating port, first tail portions extending rearwardly beyond the insulative housing, and medium portions therebetween in a front-to-back direction and exposed into the cavity; a set of second contacts retained in the insulative housing and having second contact portions extending upon the upper side surface and exposed into the mating port to be located behind the first contact portions, and second tail portions extending rearwardly beyond the insulative housing; an insulator retained in the cavity and located adjacent to the mating port, the insulator combining with the insulative housing to hold the medium portions of the first contacts therebetween in both the front-to-back direction and a vertical direction perpendicular to the front-to-back direction; and a metal shell surrounding the tongue portion to form the mating port therebetween.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
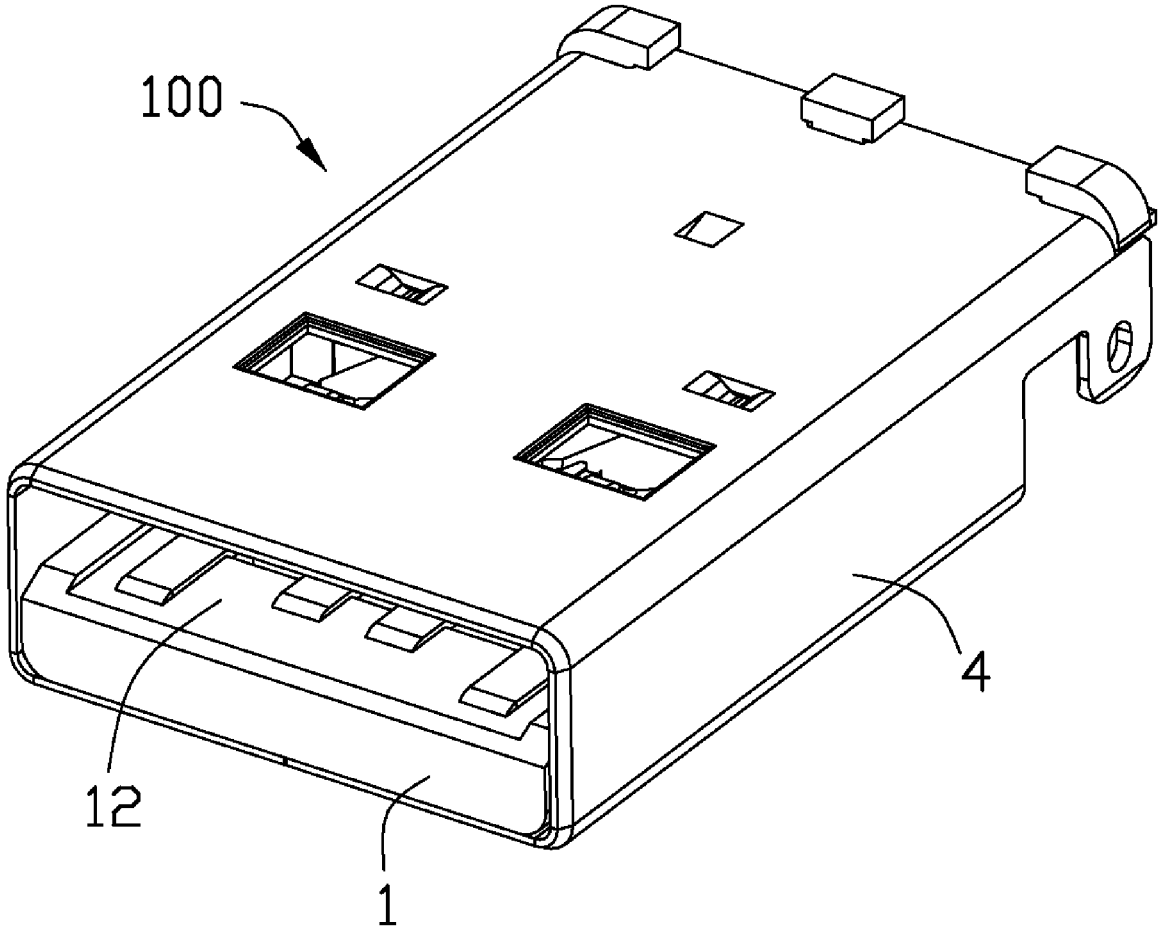
FIG. 1 is an assembled, perspective view of an electrical connector according to an embodiment of the present invention.
Figure 2:
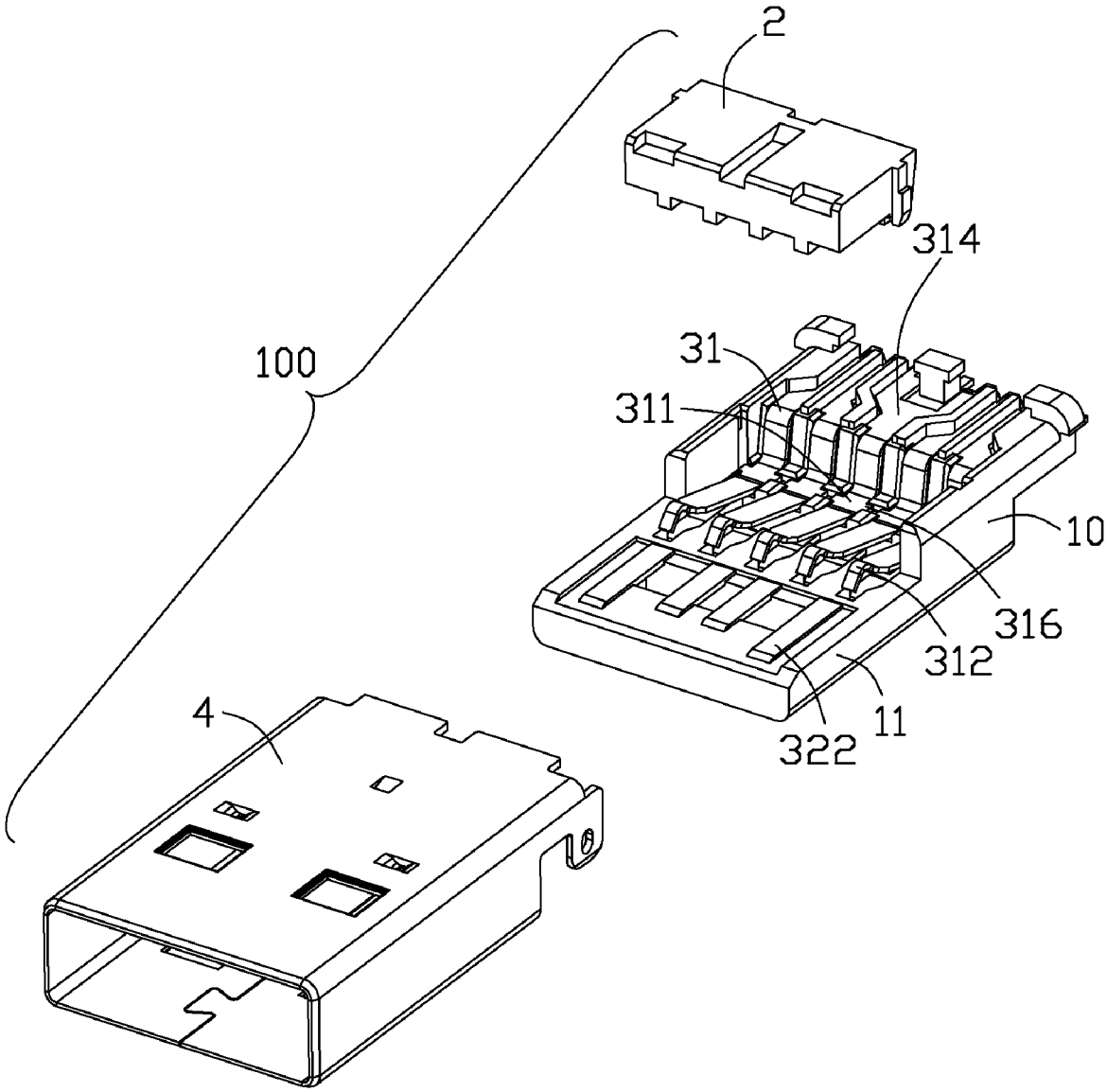
FIG. 2 is a partially exploded view of the electrical connector shown in FIG. 1.
Figure 3:
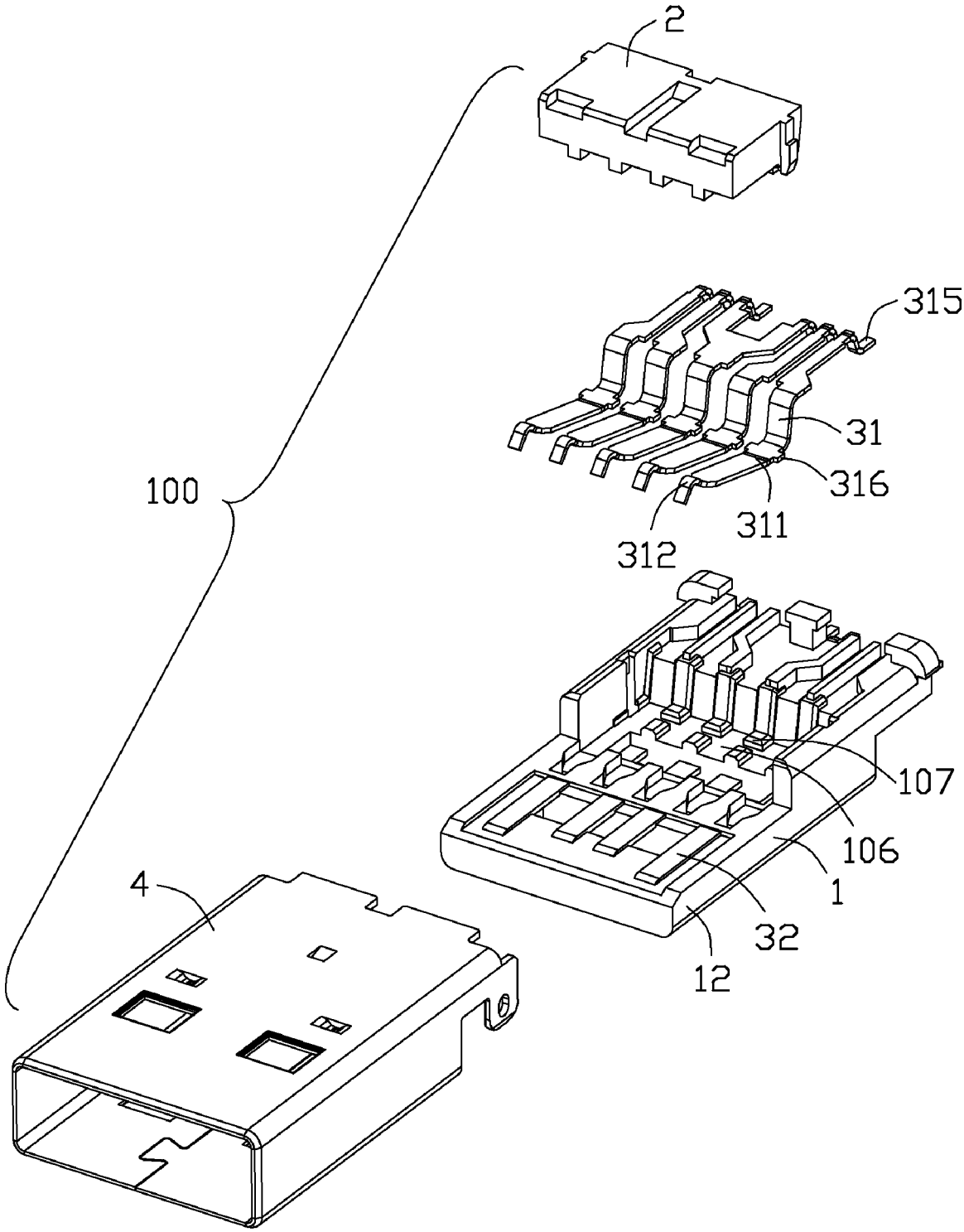
FIG. 3 is another partially exploded view of the electrical connector shown in FIG. 1.

In the following description, numerous specific details are set forth to provide a thorough understanding of the present invention. However, it will be obvious to those skilled in the art that the present invention may be practiced without such specific details.

Referring to FIGS. 1-6, an electrical connector 100 according to an embodiment of the present invention is A type USB 3.0 plug connector and defines a mating port 12. The electrical connector 100 comprises an insulative housing 1, an insulator 2 coupled to the insulative housing 1, a plurality of contacts 3 received in the insulative housing 1, and a metal shell 4 shielding the insulative housing 1 and the insulator 2.

Figure 4:
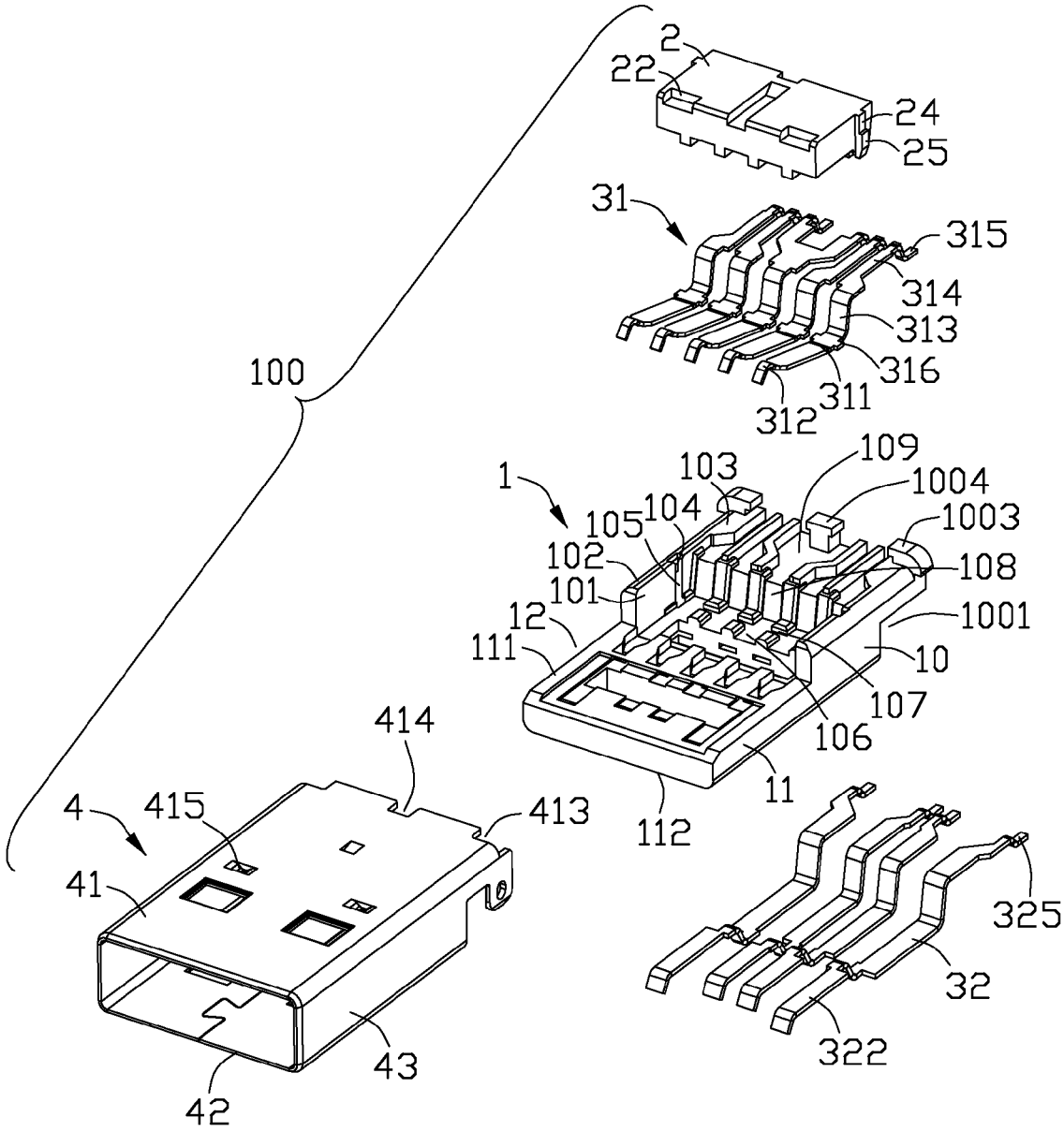
FIG. 4 is an exploded view of the electrical connector shown in FIG. 1.
Figure 5:
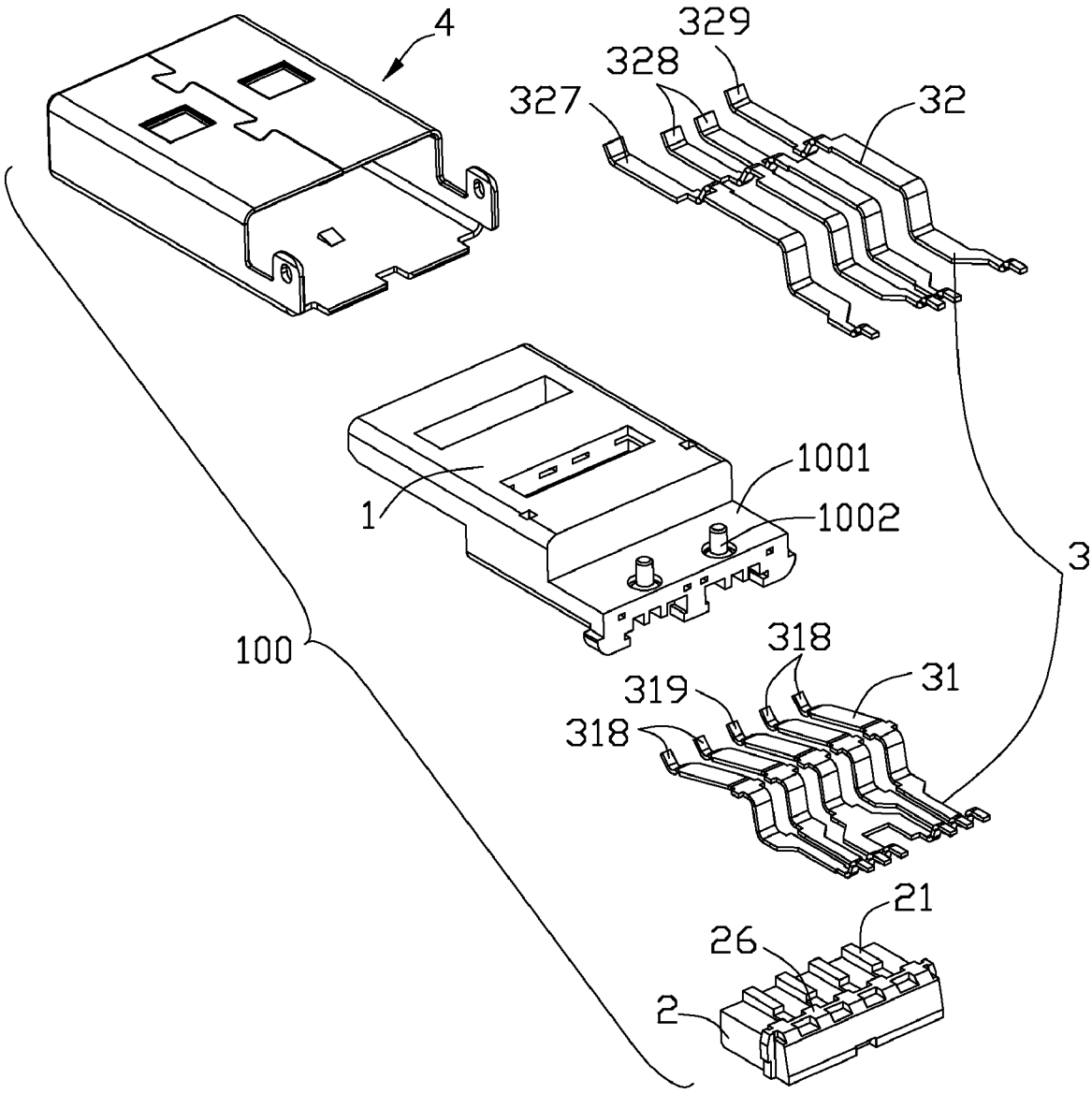
FIG. 5 is similar to FIG. 4, but viewed from another aspect.

Referring to FIGS. 4-5, The insulative housing 1 includes a base portion 10 and a tongue portion 11 extending forwardly from the base portion 10. The tongue portion 11 defines an upper side face 111, and a lower side face 112 opposite to the upper side face 111. The contacts 3 are located on the upper side face 11 and exposed into the mating port 12. The base portion 10 defines a cavity 101 extending rearwardly from the mating port 12 and recessed from an upper surface thereof, a pair of side walls 102 located at two lateral sides of the cavity 101, and a step portion 103 located at a rear side of the cavity 101. The side walls 102 each defines a recess 104 depressed outwardly from a top part of an inner surface thereof and communicating with the cavity 101, and a latching slot 105 recessed from a bottom part of the inner surface thereof with a deeper depth communicating with the recess 104. The step portion 103 has a pair of first bumps 1003 protruding upwardly and outwardly therefrom, and a second bump 1004 protruding upwardly from an upper face thereof and located between the first bumps 1003 in a transverse direction perpendicular to a front-to-back direction. The second bump 1004 is higher than the first bumps 1003.

A bottom wall of the cavity 101 defines a plurality of receiving slots 106 extending along the front-to-back direction, and a plurality of retaining slots 107 which each is communicated with each two adjacent receiving slots 106. The retaining slots 107 are arranged in a row in the transverse direction. The step portion 103 defines a plurality of holding grooves 108 extending upwardly from the corresponding receiving slots 106, and a plurality of passageways 109 recessed from the upper surface thereof and extending rearwardly from the corresponding holding grooves 108. All the receiving slots 106, the retaining slots 107 and the holding grooves 108 are in communicating with the cavity 101 respectively. The base portion 11 defines a cutout 1001 formed on a lower face thereof for receiving a printed circuit board (not shown) and a plurality of posts 1002 disposed in the cutout 1001 for being mounted into through holes of the printed circuit board.

The insulator 2 has a pair of flanges 24 protruding outwardly from two lateral side surfaces thereof, a pair of latch blocks 25 protruding outwardly from lower ends of the corresponding flanges 24, a plurality of ribs 21 formed on a lower surface thereof and a plurality of the resisting portions 26 formed on the lower surface thereof and located behind the ribs 21 respectively. The resisting portions 26 are presented as cross-shaped and connected with each other along the transverse direction.

The contacts 3 are adapted for USB 3.0 protocol, and include a number of first contacts 31 and a number of second contacts 32 being insert molded in the insulative housing 1. The first contacts 31 are adapted for USB 2.0 protocol and consist of two pairs of differential contacts 318 and a grounding contact 319 disposed between each pair of the differential contacts 318. The first contacts 31 each includes a retaining portion 311, a resilient first contact portion 312 extending forwardly from the retaining portion 311, a connecting portion 313 bending and extending upwardly from the retaining portion 311, a holding portion 314 extending rearwardly from the connecting portion 313, and at least one tail portion 315 extending beyond the insulative housing 1 from the holding portion 314. The retaining portion 311 has a pair of projections 316 protruding outwardly from two lateral sides thereof. The grounding contact 319 defines a split to form two tail portions 315 spaced from each other in the transverse direction.

The first contacts 31 are retained in the insulative housing 1 downwardly. The retaining portions 311 are received in the corresponding receiving slots 106 respectively for being prevented from moving in the transverse direction. The projections 316 are received in the corresponding retaining slots 107 for being prevented from moving along the front-to-back direction. The connecting portions 313 are received in the corresponding holding grooves 108 for being prevented from moving rearwardly and along the transverse direction. The holding portions 314 are received in the corresponding passageways 109 for being prevented from moving along the transverse direction.

The insulator 2 is received in the cavity 101 of the insulative housing 1 downwardly and cooperates with the insulative housing 1 to commonly define a whole housing contour. The flanges 24 are retained in the recess 104 of the side walls 102 of the cavity 101 to be prevented from moving in the front-to-back direction. The latching blocks 25 lock into the latching slots 105 respectively to being prevented from moving upwardly respect to the insulative housing 1. The ribs 21 abut downwardly against a bottom wall of the cavity 101. The contact portions 312 of the first contacts 31 could be receivable vertically projected within corresponding spaces between each two adjacent ribs 21. The resisting portions 26 abut downwardly against the corresponding retaining portions 311 and the projections 316 after projecting into the corresponding receiving slots 106 and retaining slots 107 respectively. Therefore, the retaining portions 311 and the projections 316 are sandwiched between the insulative housing 1 and the insulator 2 in a vertical direction.

The second contacts 32 consist of a grounding contact 329, a power contact 327 and a pair of differential contacts 328 disposed between the grounding contact 329 and the power contact 327. The second contacts 32 are insert molded into the insulative housing 1 and includes stiff contact portion 322 retained in the tongue portion 11 and exposed to the mating port 12, and tail portions 325 extending rearwardly beyond the insulative housing 1.

Figure 6:
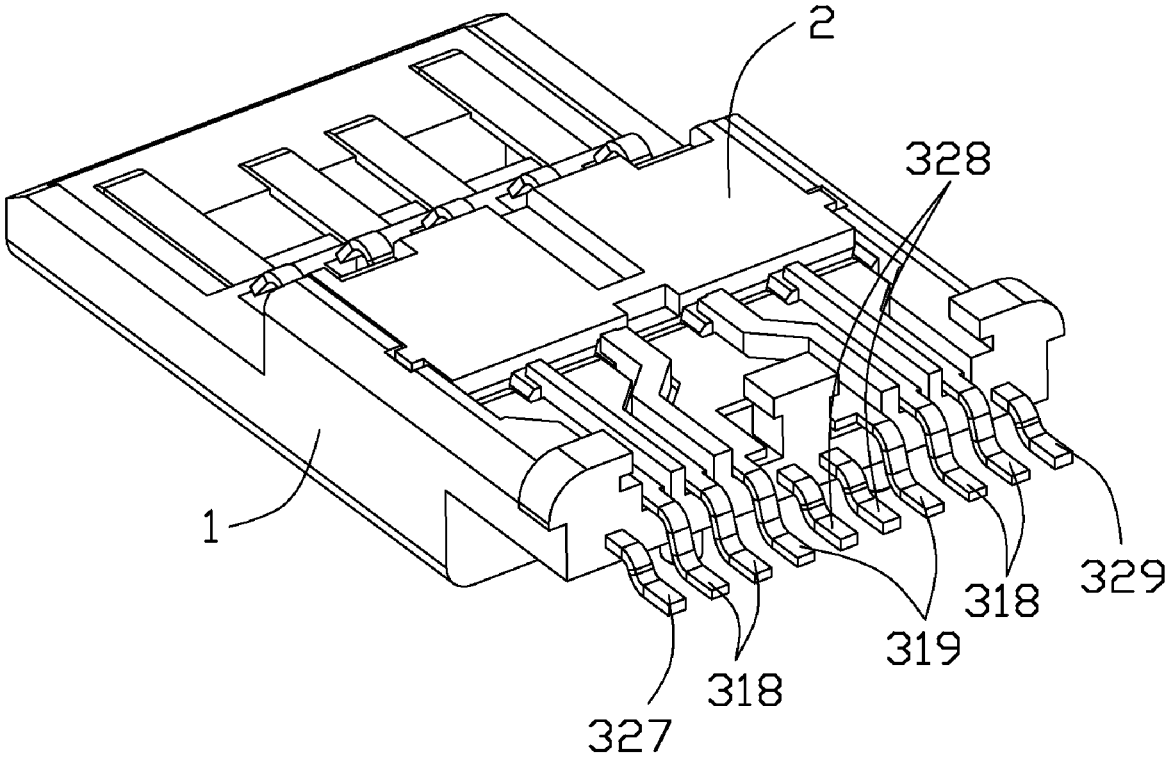
FIG. 6 is a perspective view of the electrical connector with a metal shell removed therefrom.

Referring to FIG. 6, the tail portions 315, 325 are arranged in one row, all of the tail portions 315 of the first contacts 31 are arranged between tail portions 325 of power contact 327 and the grounding contact 329 of the second contacts 32. In another word, relative to the tail portions 315, 325, the power contact 327 and the grounding contact 329 are arranged at two outermost sides. The tail portions 325 of the pair of differential contacts 328 of the second contacts 32 are arranged between the two tail portions 315 of the grounding contact 319 of the first contacts 31.

Referring to FIGS. 1 and 4, the metal shell 4 surrounds the tongue plate 11 to form the mating port 12 therebetween and includes a top plate 41, a bottom plate 42 and a pair of side plates 43 connecting the top and bottom plates 41, 42. The top plate 41 defines a pair of embosses 415 protruding inwardly to lock into a pair of depressions 22 formed on a front edge of the insulator 2 for preventing the insulator 2 from moving forwardly. The metal shell 4 has a pair of first notches 413 formed between the top plate 41 and two side plates 43 and engaging with the corresponding first bumps 1003, a second notch 414 formed in a back side of the top plate 41 and engaging with the second bump 1004. The first bumps 1003 are received in the corresponding first notches 413 and resist the metal shell 4 forwardly, inwardly and downwardly. The second bump 1004 is received in the second notch 414.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising:

an insulative housing having a base portion, and a tongue portion extending forwardly from the base portion, the base portion having a cavity recessed from an upper surface thereof, a bottom wall located below the cavity and defining a plurality of receiving slots extending along a front-to-back direction, and a plurality of retaining slots which each is communicated with each two adjacent receiving slots;

a plurality of first contacts extending along the front-to-back direction and each having a contact portion, a retaining portion extending rearwardly from the contact portion, a pair of projections protruding outwardly from two lateral sides of the retaining portion along a transverse direction perpendicular to the front-to-back direction, and a tail portion extending beyond the insulative housing, the retaining portions received in the corresponding receiving slots, and the projections positioned in the corresponding retaining slots to prevent the first contacts from moving along the front-to-back direction;

a plurality of second contacts received in the insulative housing, and each having a contact portion located at front of the contact portions of the first contacts, and a tail portion extending beyond the insulative housing; and a metal shell shielding the insulative housing, further comprising an insulator retained in the cavity and pressing onto either the retaining portion of the first contact or the projections of the first contacts to make the first contacts to be sandwiched between the insulating housing and the insulator, the tail portion of the first and the second contacts are arranged in one row in the traverse direction.

2. The electrical connector according to claim 1, wherein the electrical connector defines a mating port by the insulative housing and the metal shell, the cavity extends rearwardly from the mating port, the base portion has a step portion located at a rear side of the cavity for preventing the insulator from moving rearwardly, and a pair of side walls located at two lateral sides of the cavity for retaining the insulator in therebetween.

3. The electrical connector according to claim 1, wherein the insulator defines a plurality of ribs formed on a lower surface thereof, and a plurality of cross-shaped resisting portions formed on the lower surface thereof and located behind the ribs, the resisting portions are connected with each other along the transverse direction, the contact portions of the first contacts are located within corresponding spaces between each two adjacent ribs and project aslant, the resisting portions abut against the corresponding retaining portions and the projections after projecting into the receiving slots and retaining slots respectively.

4. The electrical connector according to claim 2, wherein the second contacts each has a connecting portion bending and extending upwardly from the retaining portion, and a holding portion extending rearwardly from the connecting portion to the tail portion, the step portion defines a plurality of passageways to position the corresponding holding portions therein.

5. The electrical connector according to claim 4, wherein the step portion has an inner front wall defining a plurality of holding grooves extending from the corresponding retaining slots to the corresponding passageways and communicating with the cavity, the holding portions are retained in the corresponding holding grooves respectively.

6. The electrical connector according to claim 2, wherein the side walls each defines a recess depressed outwardly from a top part of an inner surface thereof and communicating with the cavity, and a latching slot recessed from a bottom part of the inner surface thereof with a deeper depth communicating with the recess, the insulator has a pair of flanges protruding outwardly from two lateral side surfaces thereof, a pair of latch blocks protruding outwardly from lower ends of the corresponding flanges, the flanges are retained in the recesses downwardly, the latch blocks are locked into the latching slots respectively to prevent the insulator from moving upwardly respect to the insulative housing.

7. The electrical connector according to claim 2, wherein the step portion defines a cutout formed on a lower surface thereof for receiving a printed circuit board therein, and a plurality of posts disposed in the cutout for being mounted into through holes of the printed circuit board.

8. The electrical connector according to claim 1, wherein the second contacts are insert molded in the insulative housing and each has a stiff contact portion located upon the tongue portion, the second contacts each has a resilient contact portion extending upon the tongue portion and located behind the contacting portions of the first contacts.

9. An electrical connector with a front mating port for receiving a mating connector, comprising:

an insulative housing includes a base portion, and a tongue portion extending forwardly from the base portion, the base portion defining a rear step portion, a pair of side walls extending forwardly from two lateral sides of the step portion to form a cavity thereamong, the tongue portion defining an upper side face, and a lower side face opposite to the upper side face;

a set of first contacts retained in the insulative housing, and having first contact portions located on the upper side surface and exposed into the mating port, first tail portions extending rearwardly beyond the insulative housing, and medium portions therebetween in a front-to-back direction and exposed into the cavity;

a set of second contacts retained in the insulative housing and having second contact portions extending upon the upper side surface and exposed into the mating port to be located behind the first contact portions, and second tail portions extending rearwardly beyond the insulative housing;

an insulator retained in the cavity and located adjacent to the mating port, the insulator combining with the insulative housing to hold the medium portions of the first contacts therebetween in both the front-to-back direction and a vertical direction perpendicular to the front-to-back direction; and a metal shell surrounding the tongue portion to form the mating port therebetween, wherein the first and the second tail portions are arranged in one row along a traverse direction perpendicular to both the front to back direction and the vertical direction, two second tail portions are arranged at two outermost sides of the row.

10. The electrical connector according to claim 9, wherein the base portion defines a plurality of receiving slots recessed on a bottom surface of the cavity and receiving the medium portions therein, the insulator has a plurality of ribs pressing onto the bottom surface of the cavity, the first contact portions are located within corresponding spaces between each two adjacent ribs and project aslant.

11. The electrical connector according to claim 10, wherein the base portion further defines a plurality of retaining slots which each are communicated with each two adjacent receiving slots, the medium portions each defines a pair of projections protruding outwardly from two lateral sides thereof and located in the corresponding retaining slots to limit the first contacts from moving along the front-to-back direction.

12. The electrical connector according to claim 11, wherein the medium portions each has a retaining portion connected to the first contact portion, a connecting portion bending and extending upwardly from the retaining portion, a holding portion extending rearwardly from the connecting portion to the first tail portion, the step portion defines a plurality of holding grooves recessed on a front inner surface thereof and extending upwardly from the corresponding receiving slots, and a plurality of passageways recessed from an upper surface thereof and extending rearwardly from the corresponding holding grooves, the retaining portions, the connecting portions and the holding portions are retained in the receiving slots, the holding grooves and the passageways in turn, respectively.

13. The electrical connector according to claim 12, wherein the insulator further has a plurality of cross-shaped resisting portions connected with each other along the transverse direction, the resisting portions press onto the corresponding retaining portions and the projections after projecting into the receiving slots and retaining slots respectively.

14. An electrical connector comprising:

an insulative housing essentially defining a Z-shaped cross-section in a side view along a front-to-back direction with a front mating face exposed to an exterior in a first vertical direction perpendicular to said front-to-back direction, and a rear mounting face exposed to the exterior in a second vertical direction opposite to said first vertical direction;

a plurality of first contacts disposed in the housing and arranged with one another in a transverse direction perpendicular to both said front-to-back direction and said first vertical direction, each of said first contacts defining a front first contacting section exposed upon the mating face and a rear first tails sections exposed around the mounting face of the housing;

a plurality of second contacts disposed in the housing and arranged with one another in the transverse direction, each of said second contacts defining a front second contacting section exposed upon the mating face and a rear second tail section exposed around the mounting face under condition that the front first contacting sections and the front second contacting sections are offset from each other in both said front-to-back direction and said first vertical direction; wherein the mating face and the mounting face are essentially located at a similar level in the first vertical direction, wherein said housing defines a cavity to receive an insulator which corporates with the housing to sandwich the second contacts therebetween in the first vertical direction.

15. The electrical connector as claimed in claim 14, wherein during mating, the front first contacting sections are still while the front second contacting sections are deflectable.

16. The electrical connector as claimed in claim 15, wherein said second contacts are assembled to the housing in the second vertical direction.

17. The electrical connector as claimed in claim 14, wherein said housing is enclosed in the metallic shell, and both said housing and said shell define devices to fasten to the printed circuit board.

* * * * *